US006773090B2

(12) United States Patent
Baldwin-Garcia

(10) Patent No.: US 6,773,090 B2
(45) Date of Patent: Aug. 10, 2004

(54) MULTI-PRINTHEAD PRINTER

(75) Inventor: Daniel Baldwin-Garcia, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/907,168

(22) Filed: Jul. 17, 2001

(65) Prior Publication Data

US 2003/0016983 A1 Jan. 23, 2003

(51) Int. Cl.[7] ..... B41J 2/21
(52) U.S. Cl. ..... 347/43; 347/37
(58) Field of Search ..... 347/43, 15, 16, 347/37, 40, 12

(56) References Cited

U.S. PATENT DOCUMENTS 5,570,118 A * 10/1996 Rezanka et al. ..... 347/43
6,164,747 A * 12/2000 Yashima et al. ..... 347/15
6,234,606 B1 * 5/2001 Suzuki ..... 347/43

* cited by examiner

*Primary Examiner*—Lamson Nguyen

(57) ABSTRACT

An inkjet printer is provided. The printer includes a body, a printhead assembly disposed at least partially within the body, and a media advance system disposed at least partially within the body for advancing a media sheet within the printer. The printhead assembly includes a first printhead and a second printhead, the first and second printheads being configured to simultaneously deposit ink on the media sheet when the media sheet is positioned adjacent the printhead assembly, and to move across the media sheet in an opposed manner relative to one another during printing.

12 Claims, 2 Drawing Sheets

Fig. 2
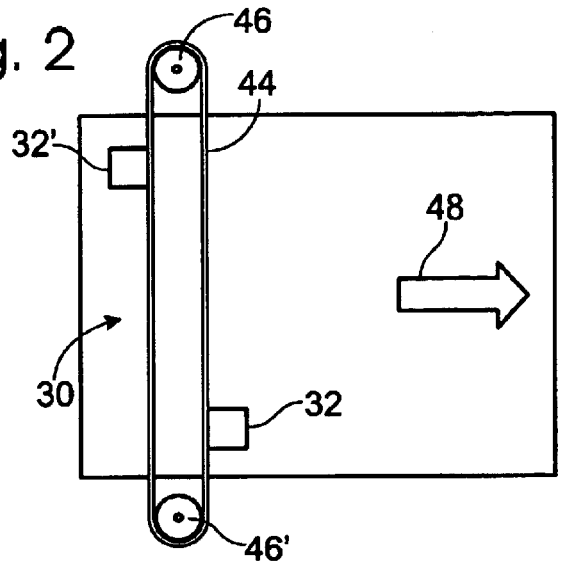
Fig. 3
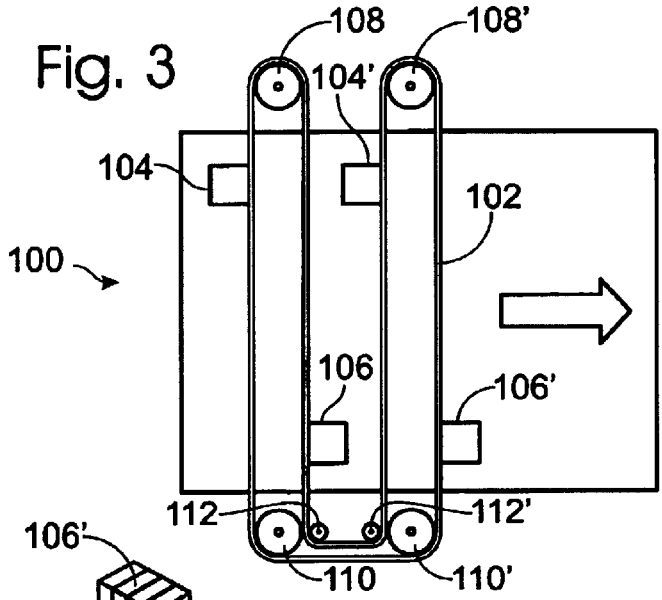
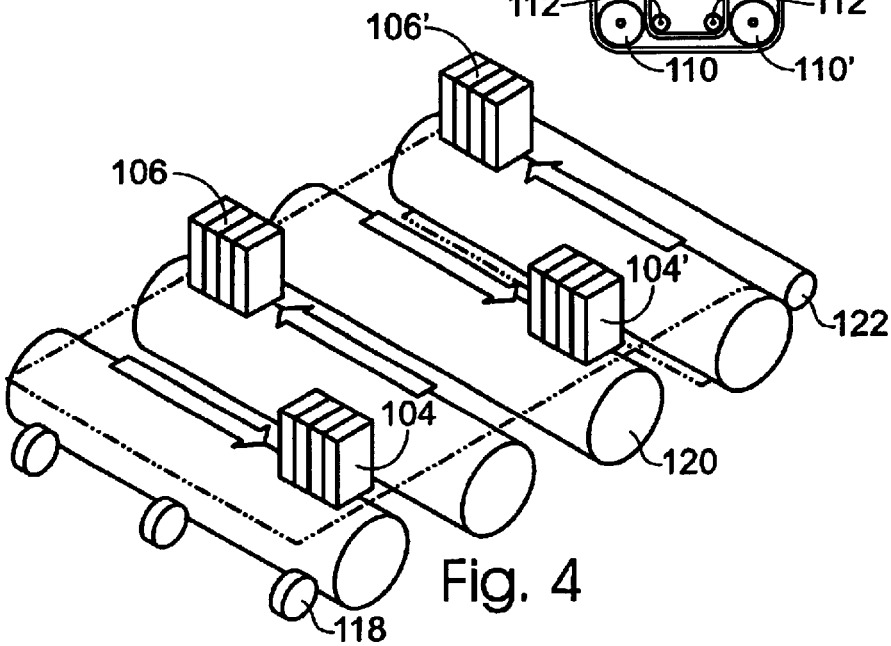
Fig. 4

MULTI-PRINTHEAD PRINTER

TECHNICAL FIELD

The present invention relates to a printer. More particularly, the invention provides a printer having a plurality of printheads configured to simultaneously deposit ink onto a sheet of media.

BACKGROUND OF THE INVENTION

In contrast to other types of printers, inkjet printers provide fast, high resolution, black-and-white and color printing on a wide variety of media, and at a relatively low cost. As a result, inkjet printers have become one of the most popular types of printers for both consumer and business applications.

Inkjet printers deposit ink onto a sheet of media by ejecting tiny drops of ink from a printhead. The inkjet printhead includes a plurality of ink ejection mechanisms, essentially tiny nozzles, arranged in an array. A typical printhead is capable of printing a horizontal strip about ½ inch high across a sheet of media in a single pass over the sheet before the sheet is advanced for the next horizontal pass. This process continues until the sheet of media has been completely printed.

The rate at which the printer can print is generally a function of how fast the printhead can make each horizontal printing pass. While current inkjet printers print at high rates of speed relative to older inkjet printers, the speed of inkjet printers remains somewhat slower than that of comparable laser printers.

One cause of the relatively slower print rates of inkjet printers is the limited frequency at which the individual ink ejection mechanisms in the printhead can eject ink bubbles, typically around 12 KHz. Increasing the printhead movement speed may speed up printing, but also may unacceptably lighten or blur the resulting print on the sheet of media. Also, the size of the printhead may be increased to increase the width of the swath printed by each pass of the printhead. However, this may greatly increase the cost of the printhead. Thus, there remains a need for an inkjet printer with increased printing speed and efficiency.

SUMMARY OF THE INVENTION

The present invention provides a printer comprising a body, a printhead assembly disposed at least partially within the body, and a media advance system disposed within the body for advancing a sheet of media within the printer. The printhead assembly includes a first printhead and a second printhead, the first and second printheads being configured to simultaneously deposit ink on a sheet of media positioned adjacent the printhead assembly and to move across the sheet of media in an opposed manner relative to one another during printing.

BRIEF DESCRIPTION OF THE DRAWINGS

FIG. 2 is a somewhat simplified top view of the print head assembly of the embodiment of FIG. 1.

FIG. 3 is a somewhat simplified top view of a print head assembly according to a second embodiment of the present invention.

FIG. 4 is a somewhat simplified perspective view of the media advance system and the print head assembly of the embodiment of FIG. 3.

DETAILED DESCRIPTION OF THE PREFERRED EMBODIMENTS

Figure 1:
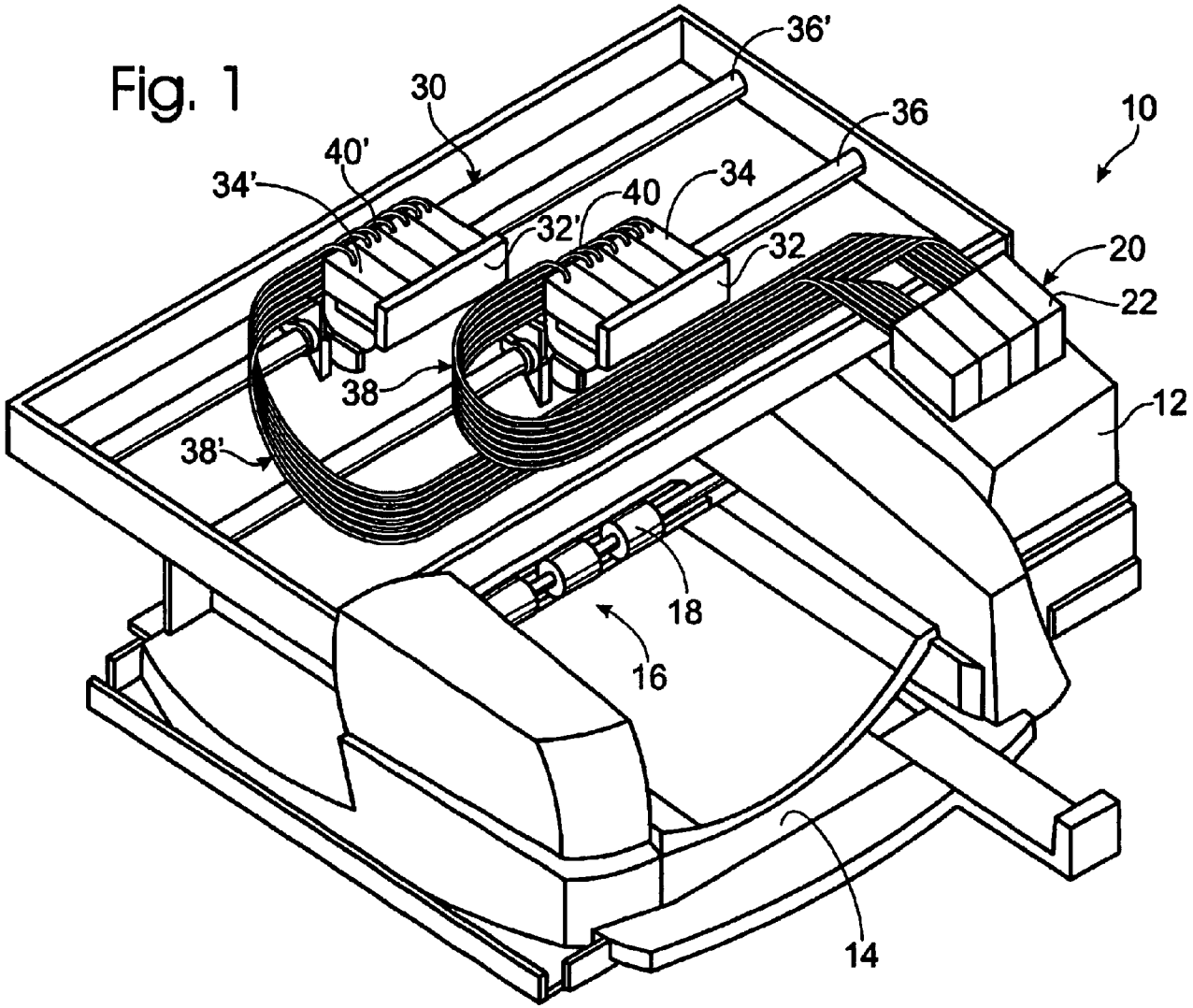
FIG. 1 is a perspective view of a printer according to a first embodiment of the present invention.

A first embodiment of the present invention is depicted generally at 10 in FIG. 1 as a desktop printer. Printer 10 includes a body 12 that houses the other components of the printer. Body 12 includes a media tray 14 configured to hold sheet media, which is fed into the printer via a media advance system 16. Media advance system 16 generally includes one or more rollers 18 for moving a sheet of media from the media tray to a position underneath the printheads, and for moving the sheet of media out of printer 10 once printing has been completed. While the depicted embodiment takes the form of a desktop printer, it will be appreciated that a printer according to the present invention may take the form of any desired printer, large or small. Furthermore, while the depicted printer 10 is configured to print on sheet media, a printer according to the present invention may be configured to print on any other desired type of media without departing from the scope of the present invention.

Printer 10 also includes an ink supply interface 20 with a plurality of ink supplies 22 containing ink for printing. Ink supply interface 20 of the depicted embodiment is configured to hold four ink supplies 22, one for black ink and one for each of the primary colors. However, ink supply interface 20 may hold either more or fewer ink supplies, depending upon whether the printer is configured to print in color or only black-and-white, and how the printer mixes inks to form colors.

Ink supply interface 20 of the depicted embodiment is positioned at a location remote from the printheads ("off-axis"). However, each ink color of the ink supply may also be positioned directly over and formed as an integral part with the corresponding printhead without departing from the scope of the present invention.

Ink supply 20 feeds ink to a printhead assembly 30, which deposits the ink onto the sheets of media. Printhead assembly 30 includes two printhead carriages, 32 and 32', each carrying one or more printheads. With two separate printhead carriages 32 and 32' moving across a media sheet and simultaneously printing ink at a rate comparable to the single printhead carriage of a conventional inkjet printer, the time necessary to complete the printing of the media sheet is greatly reduced.

As mentioned above, printhead carriages 32 and 32' each have one or more printheads. In the depicted embodiment, each printhead carriage 32, 32' has one printhead for each color of ink printed by printer 10. Therefore, each printhead carriage 32, 32' has four printheads, which are shown at 34 on printhead carriage 32 and at 34' on printhead carriage 32'. However, it will be appreciated that each printhead carriage may have any other suitable number of printheads, greater or smaller. Printhead carriages 32 and 32' each move along a corresponding carriage support rail 36 and 36', which support the printhead carriages over a media sheet while the media sheet is being printed. Electrical connections to printheads 34 and 34', not shown in this view, will typically be located at the top of the printheads.

Ink conduit ribbons, indicated at 38 and 38', run between ink supply 20 and each printhead carriage 32 and 32' to deliver ink to printheads 34 and 34'. Each ink conduit ribbon 38 and 38' includes a plurality of individual ink conduits 40, 40', each of which is configured to deliver ink of a single color to the correct printhead 34, 34'. Ink conduit ribbons 38, 38' are typically constructed of a flexible material, and have enough length to allow printhead carriages 32 and 32' to travel across the entire width of the media sheet being printed.

With the relatively rapid speeds at which it is possible to move an inkjet printhead across a sheet of media, the movement of printhead carriages 32 and 32' simultaneously across the sheet may cause printer 10 to sway or wobble during printing if printhead carriages 32 and 32' move in the same direction during any portion of the sweep across the sheet. To prevent this, printhead carriages 32 and 32' may be configured to move oppositely to one another during printing. Configuring the printhead carriages to move oppositely relative to one another also may involve making the magnitude of the horizontal velocity of printhead carriages 32 and 32' equal throughout their entire range of movement.

Any suitable mechanism may be used to move printhead carriages 32 and 32' oppositely to one another. A simple schematic diagram of one suitable mechanism is shown in FIG. 2, in which printhead carriages 32 and 32' are depicted above a sheet of media 42. In the embodiment of FIG. 2, printhead carriages 32 and 32' are mounted to a single belt 44, which is looped around a pair of rotatable guides 46, 46' in a continuous manner. At least one of guides 46 and 46' is coupled to a motor for rotating the guide, thus driving printhead carriages 32 and 32' across the media sheet. The motor will typically be bidirectional so that printhead carriages 32 and 32' may be moved reciprocally across the media sheet.

Printhead carriages 32 and 32' are mounted to belt 44 such that they are separated by at least one guide 46, 46'. Because belt 44 changes direction as it travels around guides 46 and 46', separating printhead carriages 32 and 32' by at least one guide will cause each printhead carriage 32 and 32' to move in a different direction whenever belt 44 is moved. Because belt 44 makes a full 180-degree turn around each guide 46 and 46', printhead carriages 32 and 32' move in opposite directions at equal speeds when belt 44 moves. In this manner, each movement of belt 44 in a single rotational direction sweeps both printhead carriages 32 and 32' across the media sheet, resulting in two swaths of printing. After each sweep, the media sheet is advanced as indicated by arrow 48 to position the media sheet for the next lines of printing. Although only a single guide is shown at each end of the travel paths of printhead carriages 32 and 32' in the depicted embodiment, it will be appreciated that more than one guide may be located at each end of the travel path of printhead carriages 32 and 32'.

Alignment, or registration, of printhead carriages 32 and 32' with respect to one another may be ensured by careful positioning of the printhead carriages on belt 44 during printer assembly. Registration may be tested by printing a registration pattern, for example, a "cross" or "box" shaped pattern, in dashed lines in one color using one print head from printhead carriage 32, and then printing the same pattern over top of the first pattern in a second color using one printhead from printhead carriage 32'. Any small differences in registration may be corrected via adjustments to the timing of ink ejection between printhead carriages 32 and 32', typically accomplished with software.

Generally, it is desirable for belt 44 to resist slipping on guides 46 and 46' so that printhead carriages 32 and 32' do not come out of alignment with the margins of the media sheet being printed. To avoid slippage, belt 44 may include teeth for engaging gears formed around the circumference of guides 46 and 46'. Typically, belt 44 to be constructed of a strong, high tensile strength material to avoid stretching and wear. Examples of suitable materials include those incorporating KEVLAR fibers. Alternatively, the belt may take any other suitable form, such as a chain or a cable.

Because the embodiment of FIG. 2 has a single dual-carriage printing stage, it only prints two swaths with each sweep of the printheads across the media sheet. If faster printing is desired, a plurality of dual-carriage printing stages may be used in a single printer. An example of a suitable multi-stage printhead assembly is shown generally at 100 in FIG. 3. Printhead assembly 100 includes a single belt 102 that drives two dual-carriage printing stages. The first dual-carriage printing stage includes a first pair of printhead carriages, indicated at 104 and 106, and three guides, indicated at 108, 110 and 112. The second dual-carriage printing stage is a mirror image of the first printing stage. Thus, the second dual-carriage printing stage includes a second pair of printhead carriages, indicated at 104' and 106', and three guides 108', 110' and 112'. Where a component is discussed herein in the context of the first dual-carriage printing stage, it will be understood that the discussion also applies to the equivalent component in the second dual-carriage print stage.

Guide 108 is positioned at one side of media sheet 42. Guide 108 redirects belt 102 180-degrees within the first dual-carriage printing stage, and separates printhead carriages 104 and 106 along the length of belt 102. Similarly, guide 108' redirects belt 102 180-degrees within the second dual-carriage printing stage, and separates printhead carriages 104' and 106' along the length of belt 102.

Guides 110 and 112 are positioned on the opposite side of media sheet 42 as guide 108. Guides 110 and 112 redirect belt 102 to and from the second dual-carriage print stage. Thus, guides 110 and 112 each redirect belt 102 only 90-degrees. Because printhead carriages 104, 104', 106 and 106' are all attached to the same belt, they will all have the same speed at any given time during their passages across the media sheet.

Generally, a motor will be coupled to one of guides 108, 108', 110, 110', 112 or 112' to drive the movement of belt 102. Alternatively, the motor may drive more than one guide if desired. Furthermore, instead of using a single serpentine belt to operate a plurality of dual-carriage print stages, a single motor may be used to drive a plurality of print stages having separate belts. In this manner, a plurality of individual dual-carriage print stages 30 as depicted in FIG. 2 may be arranged side-by-side along the direction of media travel. A single motor could then be coupled to one guide from each individual print stage to drive the printhead carriages of each stage. The use of a single motor will cause each belt to move in unison with the other belts, and thus help to reduce sway and wobble of printer 10 during printing.

As described above, printer 10 typically has a series of rollers 18 contained within body 12 for moving a media sheet through the printer. To ensure accurate placement of ink onto a media sheet being printed, printer 10 may be configured such that each printhead carriage prints ink onto a media sheet at a location where the backside of the media sheet is in direct contact with a roller. This is illustrated in FIG. 4 in the context of printhead assembly 100.

In FIG. 4, several different types of rollers 18 are depicted. First, feed rollers 118 are positioned to move a sheet of media from media tray 14 into the printer. Next, a series of transport rollers 120 are configured to move the media sheet through the printer. In the depicted embodiment, the media sheet is pulled along the bottom of transport rollers 120. However, it will be appreciated that the media may also move along the top of transport rollers 120 without departing from the scope of the present invention.

Once the sheet of media has been moved past the last transport roller 120, the sheet is turned upwards, where it is then drawn along the top of transport rollers 120 and underneath printhead carriages 104, 104', 106 and 106'. Each printhead carriage 104, 104', 106 and 106' is positioned directly over one of transport rollers 120. In this manner, the backside of the media sheet is always in contact with a roller when ink is being deposited. This helps to flatten the media sheet beneath the printhead carriages, and thus helps to ensure that ink is deposited precisely where it should be. In this sense, transport rollers 120 can also be described as support rollers for supporting the media sheet during printing. If printing over transport rollers 120 is not precise enough, a tensioning roller 122 may be used at either or both ends of the printhead assembly to tension the sheet over transport rollers 120, thus further insuring flatness.

Because of the fast printing speed of printer 10, it may be desirable for the printer to include a drying mechanism to dry the ink on the media sheet. Any suitable drying mechanism may be used. Examples include a heat sink disposed within printer 10 that is in contact with the back of the printed media sheet, a halogen (or other) heating light, or a heated air blower.

The disclosure set forth above encompasses multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious and directed to one of the inventions. These claims may refer to "an" element or "a first" element or the equivalent thereof; such claims should be understood to include incorporation of one or more such elements, neither requiring nor excluding two or more such elements. Inventions embodied in other combinations and subcombinations of features, functions, elements, and/or properties may be claimed through amendment of the present claims or through presentation of new claims in this or a related application. Such claims, whether directed to a different invention or to the same invention, and whether broader, narrower, equal, or different in scope to the original claims, also are regarded as included within the subject matter of the inventions of the present disclosure.

I claim:

1. A printer, comprising:

a printhead assembly, the printhead assembly including a first printhead, a second printhead, a drive belt, and a plurality of guides, the drive belt extending at least partially around each guide, wherein the first printhead and the second printhead are coupled to the drive belt such that the first printhead and the second printhead are separated by at least one guide, and wherein the first and second printheads are configured to simultaneously deposit ink on a sheet of media adjacent the printhead assembly and to move across the sheet of media oppositely to one another during printing; and a media advance system disposed within the body for advancing the sheet of media past the printhead assembly.

2. A printer, comprising:

a printhead assembly, the printhead assembly including a plurality or print stages, each print stage having a first printhead and a second printhead, the first and second printheads being configured to simultaneously deposit ink on a sheet of media adjacent the printhead assembly and to move across the sheet of media oppositely to one another during printing; and a media advance system disposed within the body for advancing the sheet of media past the printhead assembly.

3. The printer of claim 2, wherein the first printhead and the second printhead of each of the plurality of print stages are configured to simultaneously deposit ink on the sheet of media and to move across the sheet of media oppositely to one another.

4. The printer of claim 3, each print stage having opposing ends and including at least two guides, at least one guide being disposed at each opposrig end of each print stage, wherein a drive belt extends at least partially around each guide in each print stage, and wherein the first printhead in each print stage is separated from the second printhead in the print stage by at least one guide such that moving the belt in one direction causes the first printhead and the second printhead in each print stage to move oppositely to one another.

5. The printer of claim 3, the media advance system including a plurality of rollers, wherein each printhead of each print stage is configured to deposit ink on the sheet of media when the sheet of media is contacting one of the plurality of rollers.

6. The printer of claim 3, wherein the media advance system includes at least one feed roller for feeding the sheet of media through the printer and at least one tensioning roller for tensioning at least a portion of the sheet of media adjacent the printhead assembly.

7. A printer, the printer having a body, a printhead assembly disposed at least partially within the body for depositing ink onto a media sheet, and a media advance system disposed within the body for advancing the media sheet through the printer, the printhead assembly comprising:

a plurality of guides, at least one of the plurality of guides being driven by a motor;

a belt extending at least partially around each of the guides in a continuous loop; and a first printhead and a second printhead disposed on the belt, the first printhead being separated from the second printhead by at least one guide such that moving the belt in one rotational direction causes the first printhead and the second printhead to move oppositely to one another.

8. The printer of claim 7, wherein the printhead assembly includes a first printhead carriage and a second printhead carriage, the first printhead being positioned on the first printhead carriage and the second printhead being positioned on the second printhead carriage.

9. A printer, the printer having a body, a printhead assembly disposed at least partially within the body for depositing ink onto a media sheet, and a media advance system disposed within the body for advancing the media sheet through the printer, the printhead assembly comprising:

a plurality of guides, at least one of the plurality of guides being driven by a motor;

a belt extending at least partially around each of the guides in a continuous loop;

a first printhead and a second printhead disposed on the belt, the first printhead being separated from the second printhead by at least one guide such that moving the belt in one rotational direction causes the first printhead and the second printhead to move oppositely to one another;

a first printhead carriage and a second printhead carriage, the first printhead being positioned on the first printheed carriage and the second printhead being positioned on the second printhead carriage; and a third printhead carriage with a third printhead and a fourth printhead carriage with a fourth printhead disposed on the belt, the third printhead and fourth printhead being configured to deposit ink on the media sheet simultaneously with the first printhead and the second printhead, and the third printhead and fourth printhead being configured to move oppositely to one another.

10. A printer including a body, a printhead assembly disposed at least partially within the body for depositing ink on a media sheet, and a media advance system disposed within the body for advancing the media sheet, the printhead assembly comprising:

a drive belt; and a plurality of individual print stages, each print stage having opposing ends and including two printheads and at least two guides, at least one guide being disposed at each opposing end of each print stage, wherein the drive bolt extends at least partially around each guide in each print stage, and wherein each printhead in each print stage is separated from the other printhead in the print stage by at least one guide such that moving the belt in one direction causes the pair of printheads in each print stage to move in an opposed manner relative to one another.

11. The printer of claim 10, the media advance system including a plurality of rollers, wherein each print stage has a support roller, and wherein the support roller of each print stage is positioned such that the printheads of the print stage deposit ink on a region of the media sheet that is in contact with the support roller.

12. The printer of claim 10, wherein the media advance system includes a tensioning roller to tension the media sheet for the deposition of ink.

* * * * *

UNITED STATES PATENT AND TRADEMARK OFFICE

CERTIFICATE OF CORRECTION

PATENT NO. : 6,773,090 B2
DATED : August 10, 2004
INVENTOR(S) : Daniel Balwin-Garcia It is certified that error appears in the above-identified patent and that said Letters Patent is hereby corrected as shown below:

Column 6,
Line 15, delete “opposrig”, and insert in lieu thereof -- opposing --.

Signed and Sealed this

First Day of February, 2005

JON W. DUDAS
*Director of the United States Patent and Trademark Office*